US007097470B2

(12) United States Patent
Harper, Jr.

(10) Patent No.: US 7,097,470 B2
(45) Date of Patent: Aug. 29, 2006

(54) HIGH DENSITY CONNECTOR

(75) Inventor: Donald K. Harper, Jr., Harrisburg, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 11/063,375

(22) Filed: Feb. 22, 2005

(65) Prior Publication Data

US 2005/0142908 A1 Jun. 30, 2005

Related U.S. Application Data

(63) Continuation of application No. 09/661,547, filed on Sep. 14, 2000, now Pat. No. 6,886,521.

(51) Int. Cl.
*H01R 13/66* (2006.01)

(52) U.S. Cl. ..... 439/83; 439/66

(58) Field of Classification Search ..... 439/70, 439/71, 74.5, 25, 66, 83
See application file for complete search history.

(56) References Cited

U.S. PATENT DOCUMENTS

| | | | | |
|---|---|---|---|---|
| 4,774,632 | A | 9/1988 | Neugebauer | 361/386 |
| 4,975,079 | A | 12/1990 | Beaman et al. | 439/482 |
| 5,137,456 | A | 8/1992 | Desai et al. | 439/66 |
| 5,551,627 | A | 9/1996 | Leicht et al. | 228/180.22 |
| 5,669,774 | A | 9/1997 | Grabbe | 439/70 |
| 5,691,041 | A | 11/1997 | Frankeny et al. | 428/209 |
| 5,702,255 | A | 12/1997 | Murphy et al. | 439/71 |
| 5,730,606 | A | 3/1998 | Sinclair | 439/70 |
| 5,746,608 | A * | 5/1998 | Taylor | 439/70 |
| 5,850,693 | A | 12/1998 | Guran et al. | 29/884 |
| 5,872,400 | A | 2/1999 | Chapman et al. | 257/738 |
| 6,042,389 | A | 3/2000 | Lemke et al. | 439/74 |
| 6,069,482 | A | 5/2000 | Hilton | 324/755 |
| 6,093,042 | A | 7/2000 | Lemke et al. | 439/341 |
| 6,183,268 | B1 | 2/2001 | Consoli et al. | 439/74 |
| 6,827,586 | B1 * | 12/2004 | Noda et al. | 439/71 |
| 6,866,521 | B1 | 3/2005 | Harper, Jr. | 439/71 |

FOREIGN PATENT DOCUMENTS

| | | |
|---|---|---|
| GB | 2 293 502 A | 3/1996 |
| JP | 7-312242 | 11/1999 |

* cited by examiner

*Primary Examiner*—Tho D. Ta
*Assistant Examiner*—Vanessa Girardi
(74) *Attorney, Agent, or Firm*—Woodcock Washburn LLP

(57) ABSTRACT

An improved and more flexible connector assembly and method are provided for connecting an electrical component to a substrate, such as a printed circuit board (PCB), by attaching an electrical component having ball or column grid array solder portions to corresponding electrical contact surfaces of a second connector half, mating first and second connector halves and attaching the first connector half having ball or column grid array solder portions to corresponding electrical contact surfaces of the substrate. The first and second connector halves may be electrically connected to each other via conventional mating techniques. When mated, electrical communication is achieved between corresponding portions of the first and second connector halves. Effects of CTE mismatch are minimized by providing the first and second connector halves between the electrical component and substrate.

6 Claims, 8 Drawing Sheets

HIGH DENSITY CONNECTOR

CROSS-REFERENCE TO RELATED CASES

This is a continuation of U.S. patent application Ser. No. 09/661,547, entitled "High Density Connector," filed on Sep. 14, 2000 now U.S. Pat. No. 6,866,521.

BACKGROUND OF THE INVENTION

1. Field of the Invention

The present invention relates to electrical connectors and more particularly to high I/O density connectors such as connectors that are attachable to a circuit substrate or electrical component by use of a fusible element, such as a solder ball contact surface.

2. Brief Description of Prior Developments:

The drive to reduce the size of electronic equipment, particularly personal portable devices and, to add additional functions to such equipment has resulted in an ongoing drive for miniaturization of all components. Miniaturization efforts have been especially prevalent in the design of electrical connectors. Efforts to miniaturize electrical connectors have included reductions in the pitch between terminals in single or double row linear connectors, so that a relatively high number of I/O or other signals can be interconnected within tightly circumscribed areas allotted for receiving connectors. The drive for miniaturization has also been accompanied by a shift in manufacturing preference to surface mount techniques (SMT) for mounting components on circuit substrates. The confluence of the increasing use of SMT and the requirement for fine pitch has resulted in designs approaching the high volume, low cost limits of SMT. The SMT limit is being reached because further reductions in pitch greatly increase the risk of electrical bridging between adjacent solder pads or terminals during reflow of the solder paste.

To satisfy the need for increased I/O density, electrical connectors have been proposed having a two dimensional array of terminals. Such designs can provide improved density. However, these connectors present certain difficulties with respect to attachment to the circuit substrate using SMT because the surface mount tails of most, if not all, of the terminals must be attached beneath the connector body. As a result, the use of two-dimensional array connectors requires mounting techniques that are highly reliable because of the difficulty in visually inspecting the solder connections and repairing them, if faulty.

Moreover, high terminal pin densities have made terminal pin soldering more difficult, particularly in SMT if there is a lack of coplanarity between the connector and the printed circuit board. In such a situation, some of the solder joints between the terminal pins and the PCB may not be satisfactory. As a result, reliability of the connector to circuit board connection may suffer.

Floating terminal pins have been proposed to allow the connector to adjust to any irregularities between the planarity of the connector and the circuit board. Some floating terminal pins have used a through hole in the connector body with a diameter about the size of the main terminal pin. However, because the through hole has to accommodate both the terminal pin and a stop that is typically pushed into the through hole during assembly, such designs can have dimensional tolerances that present manufacturing difficulties.

Other mounting techniques for electronic components have addressed the reliability of solder connections in hard to inspect positions. For example, integrated circuit (IC) mounting to plastic or ceramic substrates, such as a PCB, have increasingly employed solder balls and other similar packages to provide a reliable attachment. In the solder ball technique, spherical solder balls attached to the IC package are positioned on electrical contact pads formed on a circuit substrate to which a layer of solder paste has been applied, typically by use of a screen or mask. The assembly is then heated to a temperature at which the solder paste and at least a portion of the solder ball melt and fuse to the contact. This heating process is commonly referred to as solder reflow. The IC is thereby connected to the substrate without need of external leads on the IC.

While the use of solder balls in connecting electrical components, such as ICs, directly to a substrate has many advantages, some flexibility is lost. For example, for electrical components or ICs that are replaced or upgraded, removal and reattachment can be a burdensome process, since generally the solder connection must be reheated to remove the electrical component. The substrate surface must then be cleaned and prepared anew for the replacement electrical component. This is especially troublesome when the overall product containing the electrical component is no longer in the control of the manufacturer, i.e., the product must be returned, or a field employee must visit the product site in order to replace the component.

Of additional concern is thermally induced stress resulting from the effects of differential Coefficients of Thermal Expansion (CTE) between the electrical component and the circuit substrate. This susceptibility is primarily due to size, material composition and geometrical differences between an electrical component, such as an IC, and a circuit substrate.

Today's ICs, e.g., can perform millions of operations per second. Each operation by itself produces little heat, but in the aggregate an IC will heat and cool relative to the surface substrate. The stressful effect on the solder joints can be severe due to the differences in CTE between an electrical component and a circuit substrate. Even if the amount of heat generated at the interface portion between the substrate and electrical component remained relatively constant, differences in size, thickness and material of the substrate will generally cause the substrate and the electrical component to expand or contract at different rates. Further, nonlinearity in the rate of change of thermal expansion (or contraction) at different temperatures can further emphasize differences in CTE. These differences in expansion rates or contraction rates can place a burdensome stress on the solder joint, and consequently, an electrical component otherwise properly attached to a circuit substrate may still be susceptible to solder joint failure due to stress from varying CTEs.

This is of particular concern for ball type solder connections since the attachment surfaces are relatively small. Additionally, a circuit or wiring board can be very large relative to the size of a component. As a result, the effects from differences in CTE between components can be amplified. Further, since there is no additional mechanical structure, e.g. a pin, for added support, the stress on a solder joint is more likely to cause an electrical connection to fail, resulting in quality problems or rendering the electrical component inoperable. This phenomena is sometimes termed CTE mismatch, referring to the reliability and thus performance of electrical connections. The greater the differential displacements created by CTE mismatch, the greater is the concern for the electrical integrity of a system. Notwithstanding some loss in flexibility and difficulties due to differences in CTEs, the use of BAN and similar systems in connecting an IC to a substrate has many advantages.

In relation to BGA connectors, it is also important that the substrate-engaging surfaces of the solder balls be coplanar to form a substantially flat mounting interface, so that in the final application the balls will reflow and solder evenly to a planar printed circuit board substrate. Any significant differences in solder coplanarity to a given substrate can cause poor soldering performance when the connector is reflowed. To achieve high soldering reliability, users specify very-tight coplanarity requirements, usually on the order of 0.004 inches. Coplanarity of the solder balls is influenced by the size of the solder ball and its positioning on the connector. The final size of the ball is dependent on the total volume of solder initially available in both the solder paste and the solder balls. In applying solder balls to a connector contact, this consideration presents particular challenges because variations in the volume of the connector contact received within the solder mass affect the potential variability of the size of the solder mass and therefore the coplanarity of the solder balls on the connector along the mounting interface.

BGA connectors have also been provided for connecting a first substrate or PCB to a second substrate or PCB, thereby electrically connecting the attached electrical components. For example, it has been proposed to secure half of a connector having a grid array of solder conductive portions to a first substrate by way of solder ball reflow, and by securing the other half of the connector having a grid array of solder conductive portions to a second substrate by way of solder ball reflow. This intermediate connector can absorb differences in CTE between the first and second substrate. Gains in manufacturing flexibility are also realized since the second substrate, with electrical component(s) attached thereto, can be removed and replaced easily. Since the second substrate is thus removable, it can be sized to match the electrical component. In this manner, CTE mismatch between the second substrate and the electrical component can be minimized.

However, even with the above described intermediate connector, it would be still further advantageous to provide a more flexible vehicle for electrically attaching an electrical component to a substrate that does not require replacing an entire second substrate, or that does not employ a second substrate at all, saving manufacturing time and materials.

Thus, there remains a need for an improved and more flexible apparatus and method for connecting an electrical component to a substrate that addresses the shortcomings of present electrical component connections, and also addresses the need to minimize or decrease CTE mismatch between an electrical component and a substrate.

SUMMARY OF THE INVENTION

An improved and more flexible connector assembly and method are provided for connecting an electrical component to a substrate, such as a printed circuit board (PCB), by attaching an electrical component having ball or column grid array solder portions to corresponding electrical contact surfaces of a second connector half, mating first and second connector halves and attaching the first connector half having ball or column grid array solder portions to corresponding electrical contact surfaces of the substrate. The first and second connector halves may be electrically connected to each other via conventional mating techniques. When mated, electrical communication is achieved between corresponding portions of the first and second connector halves. Effects of CTE mismatch are minimized by providing the first and second connector halves between the electrical component and substrate.

DETAILED DESCRIPTION OF THE DRAWINGS

The apparatus assembly and method of the present invention are further described with reference to the accompanying drawings in which.

DETAILED DESCRIPTION OF PREFERRED EMBODIMENTS

Use of the present invention involves four components: an electrical device, a first connector half, a second connector half and a substrate. The electrical device has a ball or column grid array system or other type solder portions that attach to the first connector half upon reflow. The first connector half is matable to a second connector half. The second connector half is electrically connected to a substrate via ball or column grid array systems or other type solder portions. The first and second connector halves form a connector when mated, and any type of connector, such as an array connector may be utilized.

Figure 1:
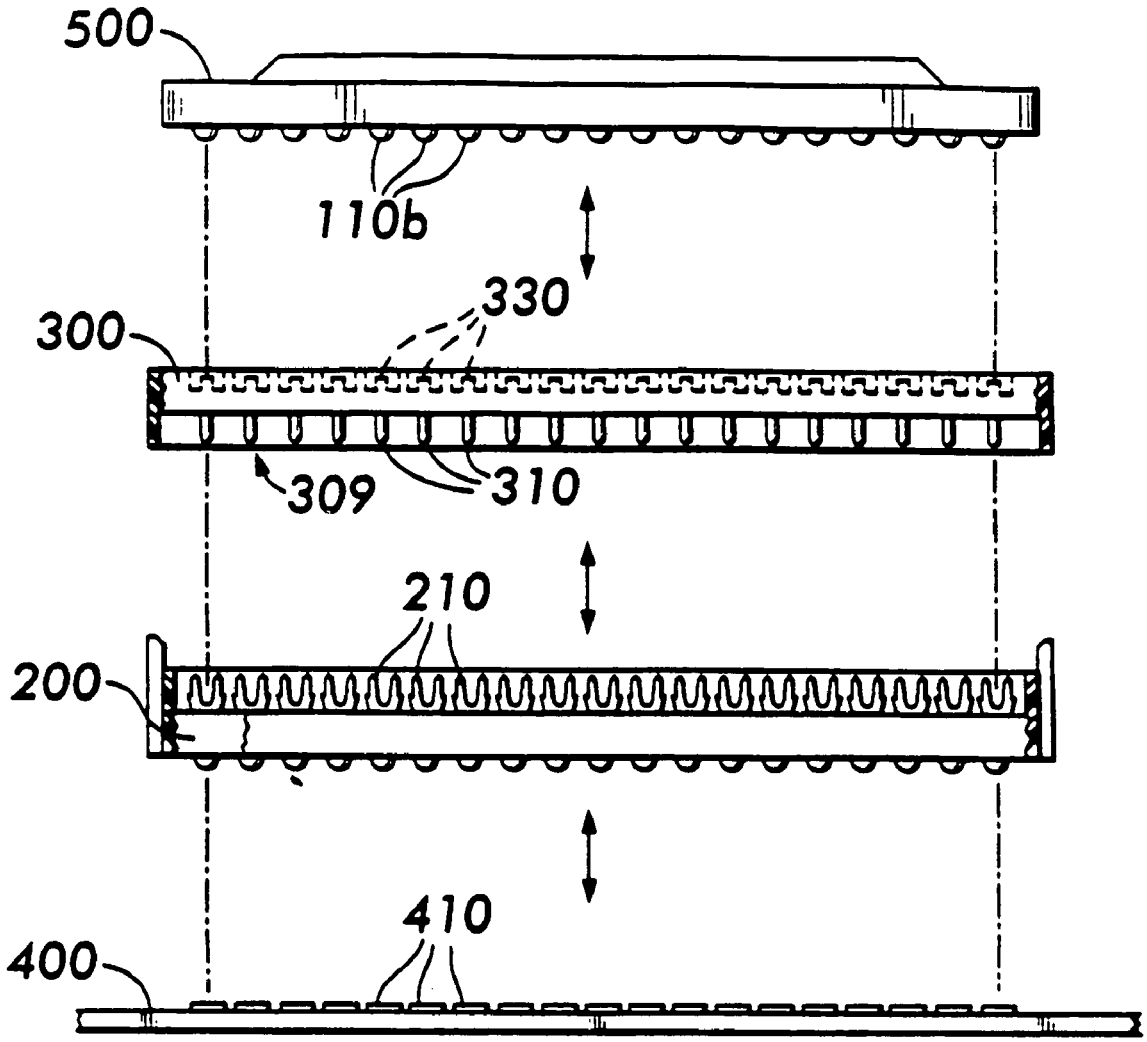
FIG. 1 is a side view illustration of a first connector half with ball type contact portions, a substrate on which the first connector half is to be mounted, an electrical component or other similar component having ball type contact portions, and a second connector half on which the electrical component is to be mounted in accordance with the present invention.
Figure 2:
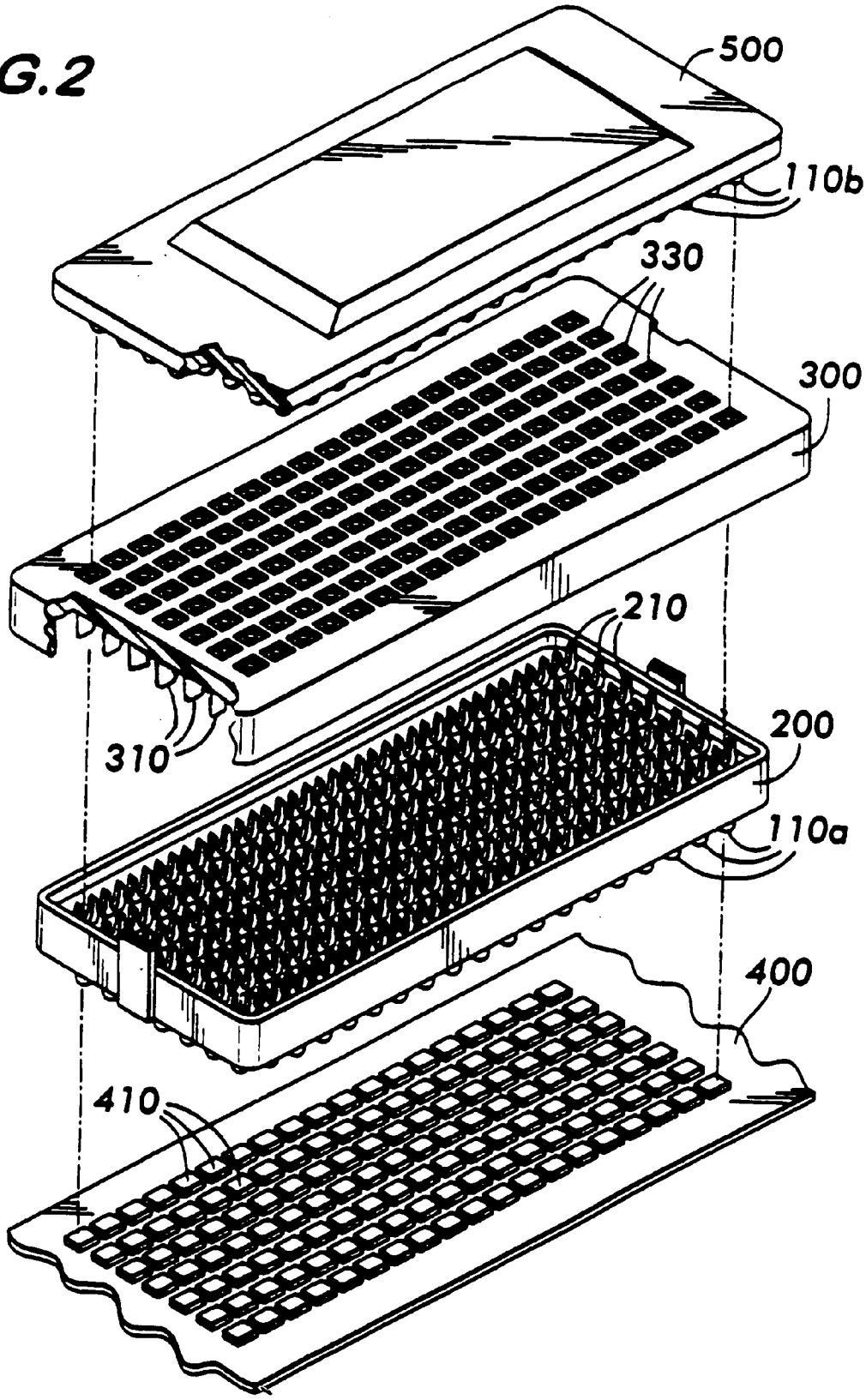
FIG. 2 is a perspective view illustration of a first connector half with ball type contact portions, a substrate on which the first connector half is to be mounted, an electrical component or other similar component having ball type contact portions, and a second connector half on which the electrical component is to be mounted in accordance with the present invention.
Figure 3:
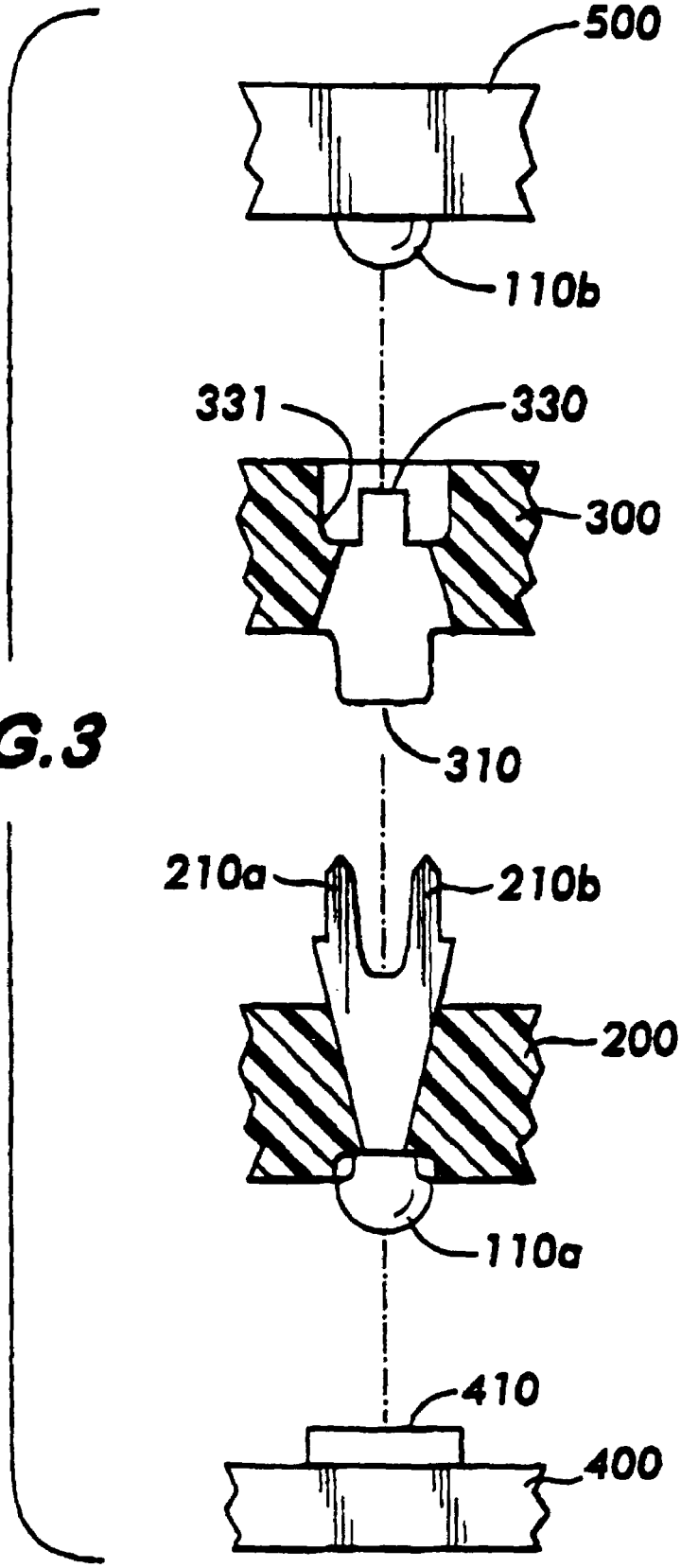
FIG. 3 is an isolated view illustration of a first connector half with ball type contact portions, a substrate on which the first connector half is to be mounted, an electrical component or other similar component having ball type contact portions, and a second connector half on which the electrical component is to be mounted in accordance with the present invention.

Referring to FIGS. 1 through 3, the component to connector to substrate assembly includes a first connector half 200, such as an array connector half having fusible elements such as ball type contact portions 110*a*, a substrate 400, such as a PCB, on which the first connector half 200 is to be mounted, an electrical device 500 or other similar component having fusible elements such as ball type contact portions 110*b*, and a second connector half 300 on which the electrical device 500 is to be mounted. The electrical device 500 may be attached to the body of the second connector half 300 by solder reflow of the array of ball type contact portions 110*b* onto a corresponding array of contacts 309. The body of contacts 309 have mating portions 310 and mounting regions 330. The mounting regions 330 preferably reside within a recess 331 in the bottom of connector 300.

The second connector half 300 mates with the first connector half 200 via the insertion of pin or blade portions 310 into receptacle contacts 210. However, contact portions 210 and 310 may be any type of matable connector contact portions. As shown in the exemplary embodiment, first contact portions 210 are dual beams (FIG. 3) and second contact portions 310 are blades. Contact mounting regions 330, while depicted in FIG. 4 as a straight tail, may be variously formed to provide electrical contact between contact portions 310 and ball type contact portions 110*b*. For example, contact portions 310 may extend above the surface of a contact mounting region 330 for connection to ball type contact portions 110*b* after reflow or the tail could be a tab bent to a portion parallel to device 500.

The first connector half 200 includes an array of fusible elements such as ball type contact portions 110*a* that may be attached to substrate 400 by solder reflow. Connector half 200 also includes an array of dual beam contacts 210 that mate with corresponding contact portions 310. The substrate 400 has an array of solder pads 410 corresponding to the array of ball type contact portions 110*a*. When connector half 200 is placed on substrate 400, an electrical connection may be made via solder reflow between the ball type contact portions 110*a* and contacts 410 since in conventional applications, component 500 would directly mount to substrate 400.

Thus, in accordance with the present invention, the connector halves 200 and 300 may be mated together forming an electrical connection between the component 500 and the substrate 400. Use of this novel assembly has the added benefit that the connector halves absorb differentials in CTEs between the component 500 and substrate 400 since in conventional applications, component 500 would directly mount to substrate 400.

As shown in more detail in the isolated view of FIG. 3, solder ball 110*b* of electrical device 500 is adapted to attach to contact 330 of second connector half 300 by way of solder reflow. Solder ball 110*a* of first connector half 200 is adapted to be connected to the contact region 410 of substrate 400 by way of solder reflow as well. Subsequently, second contact portion 310 is mated to first contact portion 210.

Typically, the mating between connector halves 200 and 300 is achieved by inserting contact portion 310 between fingers 210*a* and 210*b*. The substantially straight elongated connector portion 310 pushes elongated connector portions 210*a* and 210*b* away from one another in a direction substantially orthogonal to the mating direction, thereby spring biasing the connecting portions 210*a* and 210*b* against connector portion 310. The spring biasing and wiping action during insertion helps bolster the electrical integrity of the electrical connection. Contact portions 210*a* and 210*b* can have any configuration suitable for establishing an electrical connection. For example, they may have a curved "S" or double "C" shape. Moreover, portions 210*a* and 210*b* may be formed from a single piece of contact material, although separate pieces can be placed together.

In this fashion, CTE mismatch problems due to differences in size and material composition between a component 500 and a substrate 400 can be avoided. The bodies 200 and 300 of the connector provide a middle ground, in effect, to spread out any mismatch that may exist over a greater distance and over more pliant or flexible materials, less prone to mismatch problems.

Figure 4:
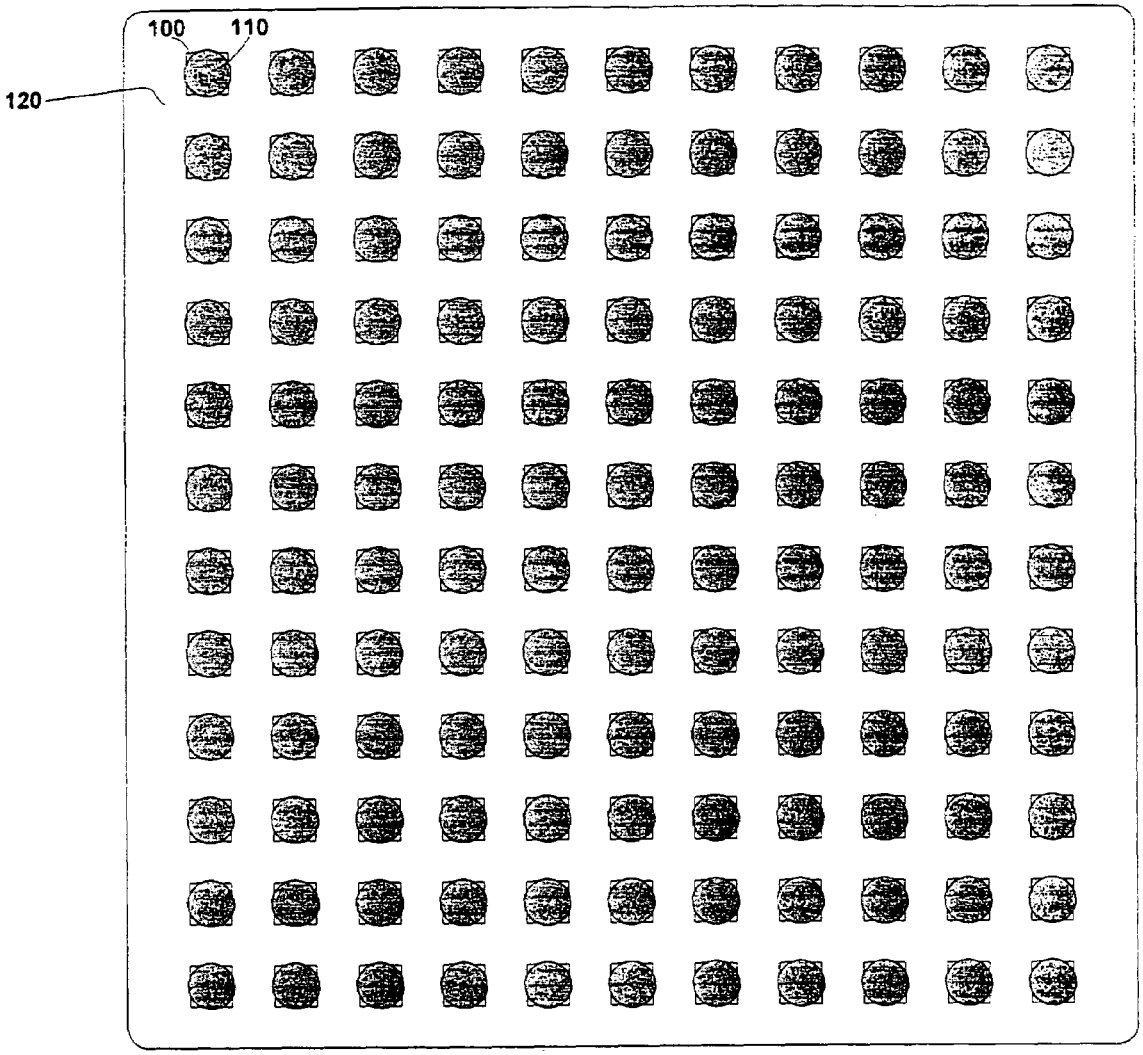
FIG. 4 is an illustration of an element having ball type contact portions in accordance with the present invention.

FIG. 4 is an illustration of an element having an array of ball type contact portions constructed in accordance with the present invention. As shown on a surface of body 120, contacts 100 are formed for the reception of ball type contact portions 110. A discussion of methods of securing a solder ball to a contact and to a PCB is contained in International Publication number WO 98/15989 (International Application number PCT/US97/18066), the teachings of which are hereby incorporated by reference.

Figure 5A:
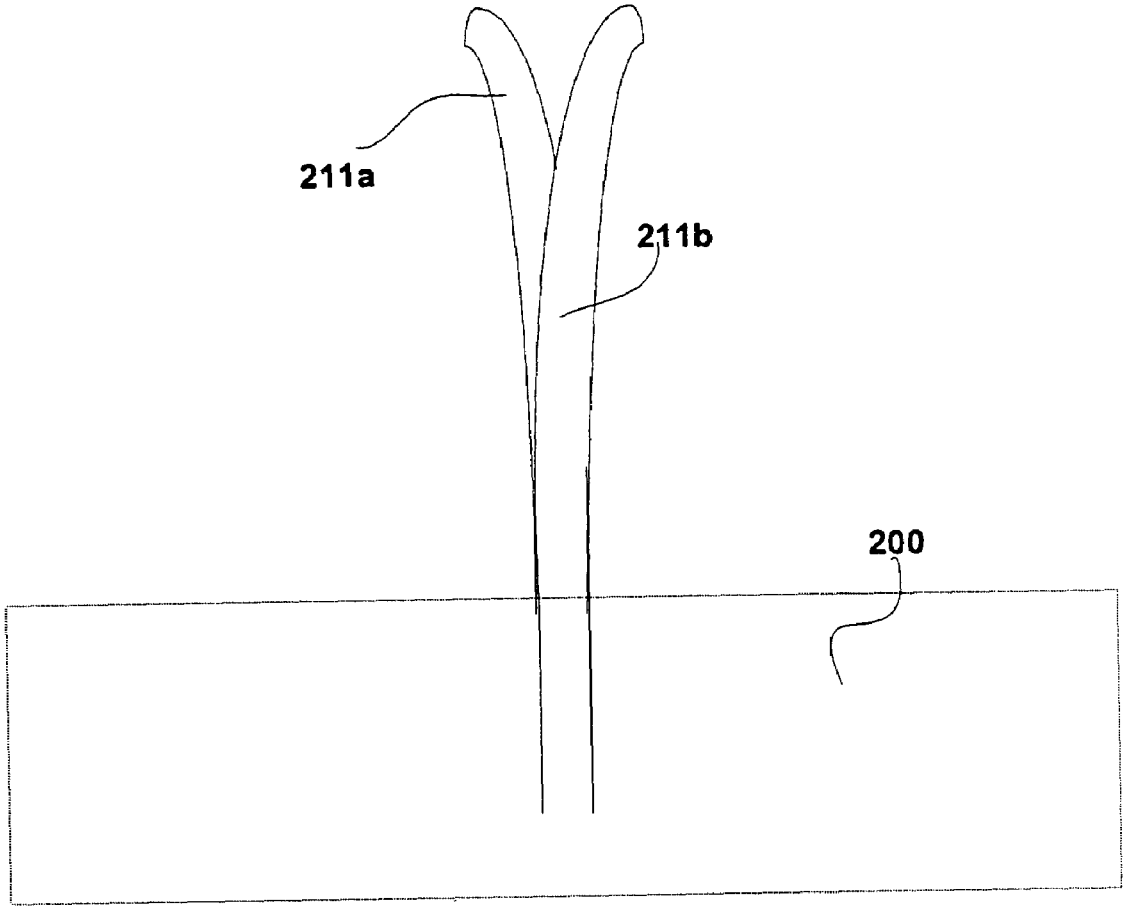
FIGS. 5A through 5C are illustrations of alternate embodiments for connector mating portions in accordance with the present invention.

FIG. 5A illustrates an alternate embodiment of contact portions 210. As shown, the contact portion 210 has elongated connector portions 211*a* and 211*b* electrically attached to first connector half 200. In FIG. 5A, elongated connector portions 211*a* and 211*b* have an outwardly arced or bent shape. Portions 211*a* and 211*b* are preferably formed from a single piece of contact material, although separate pieces can also be placed together.

Figure 5B:
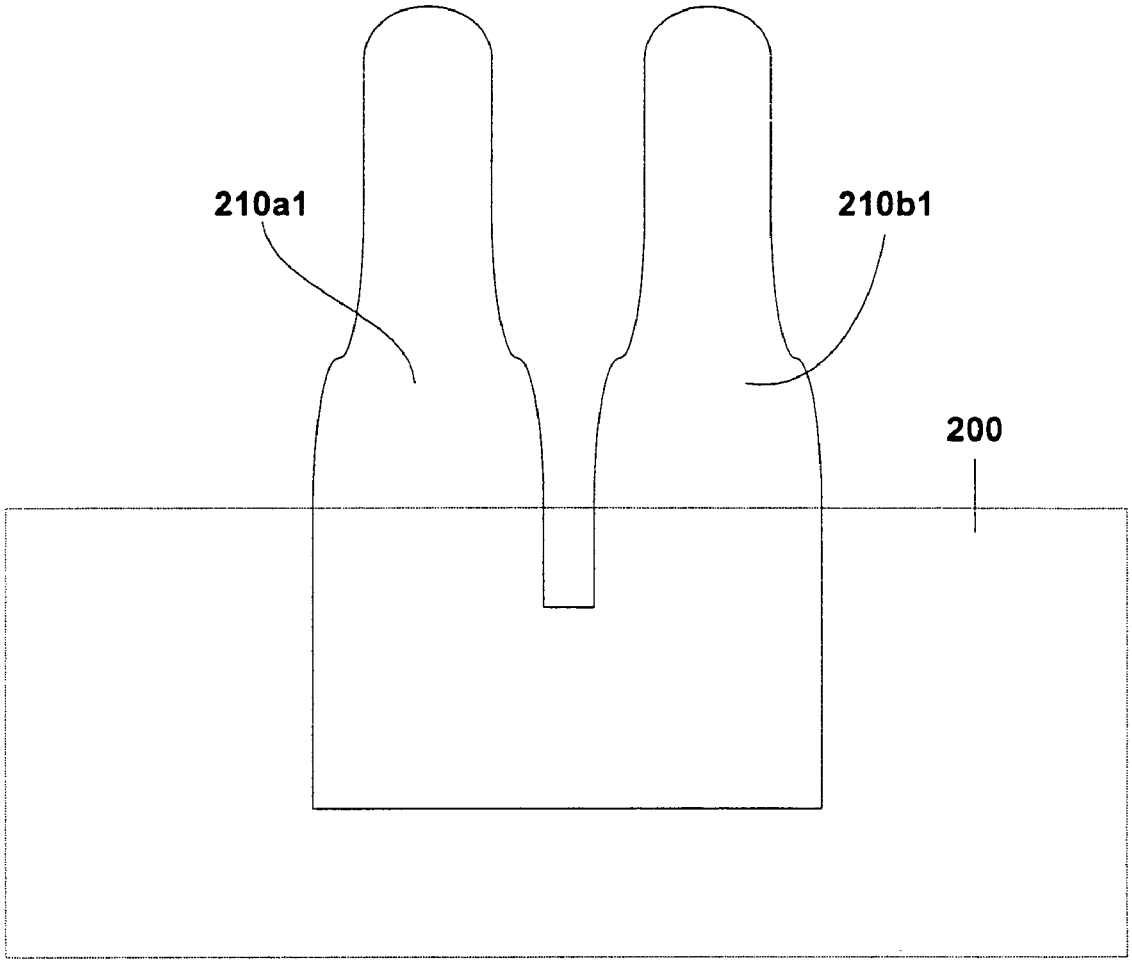
Figure 5C:
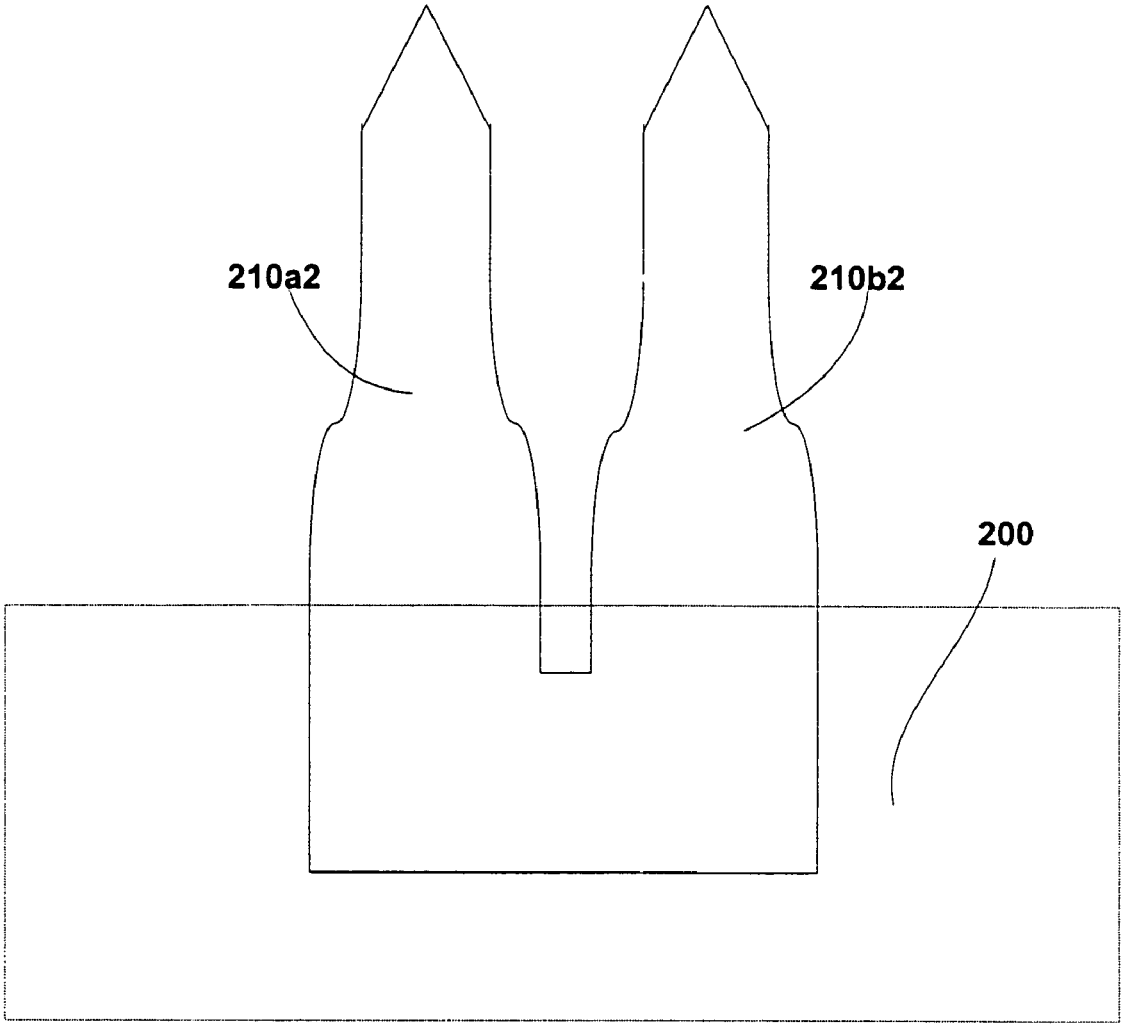

In FIG. 5B, connector portions 210*a*1 and 210*b* 1 of contact portion 210 are separate elongations with a rounded tip, and are formed from a single piece of contact material. Similarly, in FIG. 5C, connector portions 210*a*2 and 210*b*2 of contact portion 210 are separate elongations with a substantially pointed tip, and are formed from the same contact material.

Substantially straight elongated contact portion 310 pushes elongated connector portions 210*a* and 210*b* away from one another in a direction substantially orthogonal to the mating direction, thereby causing wiping to occur during insertion and spring biasing the contact portions 210*a* and 210*b* against connector portion 310. This spring biasing helps to bolster the electrical integrity of the electrical connection established by the first and second connector halves 200 and 300.

Figure 6:
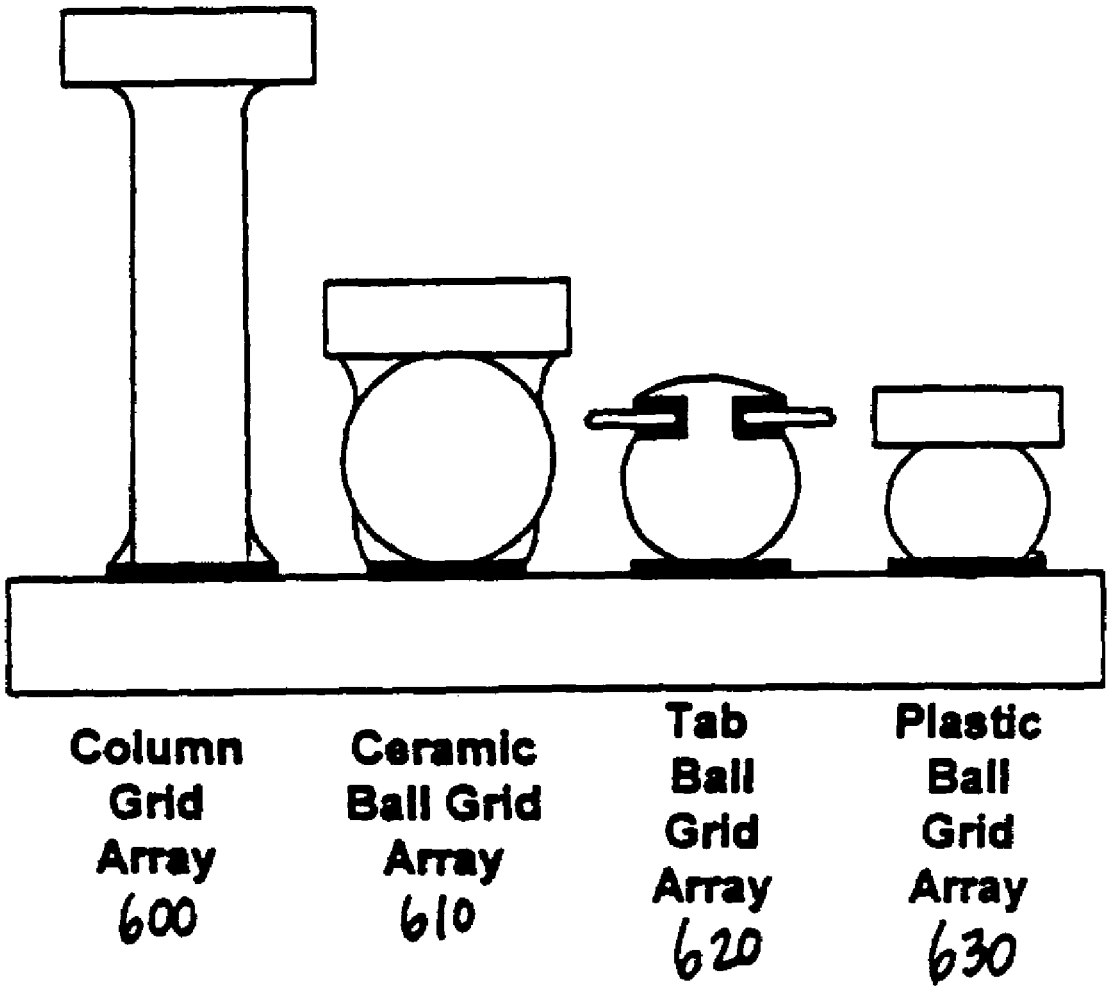
FIG. 6 is an illustration of alternative grid array contact portions that may be utilized in accordance with the present invention.

FIG. 6 illustrates alternative grid array contact portions on device 500 that may be used in accordance with the present invention. Thus far, ball type contact portions 110 have been described and illustrated. However, many different types of array type contact portions can be used in accordance with the present invention depending on the application for which a component 500 is suited, depending on the materials comprising either the substrate 400 or component 500, or depending on the type of manufacture for the substrate 400 or component 500. Thus, column grid array contact portions 600, ceramic ball grid array contact portions 610, tab ball grid array contact portions 620 and plastic ball grid array contact portions 630 may all be used within the spirit and scope of the present invention.

The fusible contacts 110 on the electrical device 500 and contacts 330 on the second array connector will preferably be a solder ball. It is noted, however, that it may be possible to substitute other fusible materials which have a melting temperature less than the melting temperature of the elements being fused together. The fusible element, such as a solder ball, can also have a shape other than a sphere. As mentioned, examples include column grid arrays 600, ceramic ball grid arrays 610, tab ball grid arrays 620 and plastic ball grid arrays 630.

When the conductive or fusible element is solder, it will preferably be an alloy which is in the range of about 10% Sn and 90% Pb to about 90% Sn and 10% Pb. More preferably the alloy will be eutectic which is 63% Sn and 37% Pb and has a melting point of 183° C. Typically, a "hard" solder alloy with a higher lead content would be used for mating materials such as ceramics. A "hard" contact will "mushroom" or deform slightly as it softens. A "soft" eutectic ball reflows and reforms at lower temperatures. Other solders known to be suitable for electronic purposes are also believed to be acceptable for use in this method. Such solders include, without limitation, electronically acceptable tin-antimony, tin-silver and lead silver alloys and indium.

Before the conductive element is positioned in a recess, that recess is usually filled with a solder paste.

While it is believed that a solder paste or cream incorporating any conventional organic or inorganic solder flux may be adapted for use in this method, a so-called "no clean" solder paste or cream is preferred. Such solder pastes or creams would include a solder alloy in the form of a fine powder suspended in a suitable fluxing material. This powder will ordinarily be an alloy and not a mixture of constituents. The ratio of solder to flux will ordinarily be high and in the range of 80%–95% by weight solder or approximately 50% by volume. A solder cream will be formed when the solder material is suspended in a rosin flux. Preferably the rosin flux will be a white rosin or a low activity rosin flux, although for various purposes activated or superactivated rosins may be used. A solder paste will be formed when a solder alloy in the form of a fine powder is suspended in an organic acid flux or an inorganic acid flux. Such organic acids may be selected from lactic, oleic, stearic, phthalic, citric or other similar acids. Such inorganic acids may be selected from hydrochloric, hydrofluoric and orthophosphoric acid. Cream or paste may be applied by brushing, screening, or extruding onto the surface which may advantageously have been gradually preheated to ensure good wetting.

Heating or solder reflow is preferably conducted in a panel infra red (IR) solder reflow conveyor oven. The components with solder portions would then be heated to a temperature above the melting point of the solder within the solder paste.

While the present invention has been described in connection with the preferred embodiments of the various figures, it is to be understood that other similar embodiments may be used or modifications and additions may be made to the described embodiment for performing the same function of the present invention without deviating therefrom. It will be appreciated by those of ordinary skill in the art that the description given herein with respect to those Figures is for exemplary purposes only and is not intended in any way to limit the scope of the invention.

For example, an electrical connector is described herein having a substantially square or rectangular mounting surface. However, the particular dimensions and shapes of connectors shown and described are merely for the purpose of illustration and are not intended to be limiting. The concepts disclosed herein have a broader application to a much wider variation of connector mounting surface geometries. The concepts disclosed with reference to this connector assembly could be employed, for example, with a connector having a connection mounting surface having a more elongated, irregular or radial geometry.

Further, the first and second connector halves are described with reference to an array of plug contact mating ends 310 on the second connector half 300 being insertable into an array of corresponding dual-pronged receptacle mating portions 210 on the first connector half 200 to achieve electrical communication between the first and second connector halves. However, a variety of pin to receptacle implementations are available for use, and could be employed in the present invention to achieve electrical communication by inserting the first connector half into the second connector half, or vice versa. Further, the first connector half elongated portions 210*a* and 210*b* are interchangeable with the second connector half elongated portion 310 and vice versa. Therefore, the present invention should not be limited to any single embodiment, but rather construed in breadth and scope in accordance with the recitation of the appended claims.

What is claimed is:

1. An electrical connector comprising:

a connector body having a first surface, a second surface, and a passageway defined between said first surface and said second surface; and an electrical contact positioned in said passageway, said electrical contact having a first end and a second end, said first end lacking solder mass sufficient to reflow and said second end lacking solder mass sufficient to reflow, wherein said first end is adapted to receive a solder mass attached to an electrical component, and said second end is adapted to be received by a mating connector having a solder mass for reflow connection to contacts a substrate, wherein physical connection between the second end and the mating connector may be readily made and broken repeatedly independent of auxiliary fastening of the connector body to the substrate.

2. The electrical connector of claim 1, wherein said first end is situated substantially inside said passageway.

3. The electrical connector of claim 1, wherein said first end is adapted to receive a ball-type contact from the component.

4. The electrical connector of claim 1, wherein said body comprises a plurality of passageways defined between said first surface and said second surface, and further comprising a plurality of electrical contacts disposed in said plurality of passageways.

5. The electrical connector of claim 4, wherein each of said plurality of electrical contacts lacks solder sufficient for reflow.

6. The electrical connector of claim 1, wherein said component is an integrated circuit.

* * * * *

UNITED STATES PATENT AND TRADEMARK OFFICE

CERTIFICATE OF CORRECTION

PATENT NO. : 7,097,470 B2
APPLICATION NO. : 11/063375
DATED : August 29, 2006
INVENTOR(S) : Donald K. Harper, Jr.

It is certified that error appears in the above-identified patent and that said Letters Patent is hereby corrected as shown below:

Col. 8, line 30 (claim 1), after "contacts" insert --on--

Signed and Sealed this

Seventh Day of November, 2006

JON W. DUDAS
*Director of the United States Patent and Trademark Office*